US010765292B2

(12) United States Patent
Ko et al.

(10) Patent No.: US 10,765,292 B2
(45) Date of Patent: Sep. 8, 2020

(54) RACK AND DISHWASHER INCLUDING THE SAME

(71) Applicant: LG Electronics Inc., Seoul (KR)

(72) Inventors: Myungwon Ko, Seoul (KR); Kitae Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 69 days.

(21) Appl. No.: 15/745,867

(22) PCT Filed: Aug. 17, 2016

(86) PCT No.: PCT/KR2016/009020
§ 371 (c)(1),
(2) Date: Jan. 18, 2018

(87) PCT Pub. No.: WO2017/030359
PCT Pub. Date: Feb. 23, 2017

(65) Prior Publication Data

US 2018/0206701 A1 Jul. 26, 2018

(30) Foreign Application Priority Data

Aug. 18, 2015 (KR) ..... 10-2015-0116195

(51) Int. Cl.
*A47L 15/50* (2006.01)

(52) U.S. Cl.
CPC ..... *A47L 15/506* (2013.01); *A47L 15/502* (2013.01); *A47L 15/503* (2013.01); *A47L 15/505* (2013.01); *A47L 15/507* (2013.01)

(58) Field of Classification Search
None
See application file for complete search history.

(56) References Cited

U.S. PATENT DOCUMENTS 9,629,515 B2 * 4/2017 Chan ..... A47L 15/503
2005/0109378 A1 * 5/2005 Landsiedel ..... A47L 15/14 134/135

(Continued)

FOREIGN PATENT DOCUMENTS

CN 104757926 A 7/2015
DE 102005056886 A 2/2007

(Continued)

OTHER PUBLICATIONS

Espacenet translation CN104757926, Tray assembly for dish washing machine, Cao, 2015 (Year: 2015).*

(Continued)

*Primary Examiner* — Cristi J Tate-Sims
(74) *Attorney, Agent, or Firm* — Fish & Richardson P.C.

(57) ABSTRACT

A dishwasher (100) is disclosed. The dishwasher includes a washing tub (130) for defining a washing space, a rack (150) provided in the washing tub (130) so as to be withdrawn from the washing tub (130) for receiving dishes, and a plurality of spraying units (132, 133, 134), for spraying wash water to the rack (150). The rack (150) includes a receiving box (210) having a loading unit (215) on which dishes are loaded and a turnable withdrawal unit (250) coupled to the loading unit (215) in a state of being in contact with the loading unit (215) so as to be turned upward for separating the dishes, loaded on the loading unit (215), from the loading unit (215) when turned.

14 Claims, 5 Drawing Sheets

(56) References Cited

U.S. PATENT DOCUMENTS

| | | | | |
|---|---|---|---|---|
| 2005/0242046 | A1 | 11/2005 | Lee | |
| 2006/0250058 | A1* | 11/2006 | Stevens | A47L 15/502 312/311 |
| 2015/0208899 | A1* | 7/2015 | Lee | A47L 15/502 134/201 |

FOREIGN PATENT DOCUMENTS

| | | |
|---|---|---|
| DE | 102011080842 | 2/2013 |
| WO | WO2015039504 | 3/2015 |
| WO | WO2015039504 A | 3/2015 |
| WO | WO2016077977 | 5/2016 |

OTHER PUBLICATIONS

European Search Report in European Appln. No. 16837301.7, dated Dec. 19, 2018, 9 pages.

International Search Report and Written Opinion in International Application No. PCT/KR2016/009020, dated Nov. 22, 2016, 10 pages.

* cited by examiner

[Fig. 1]
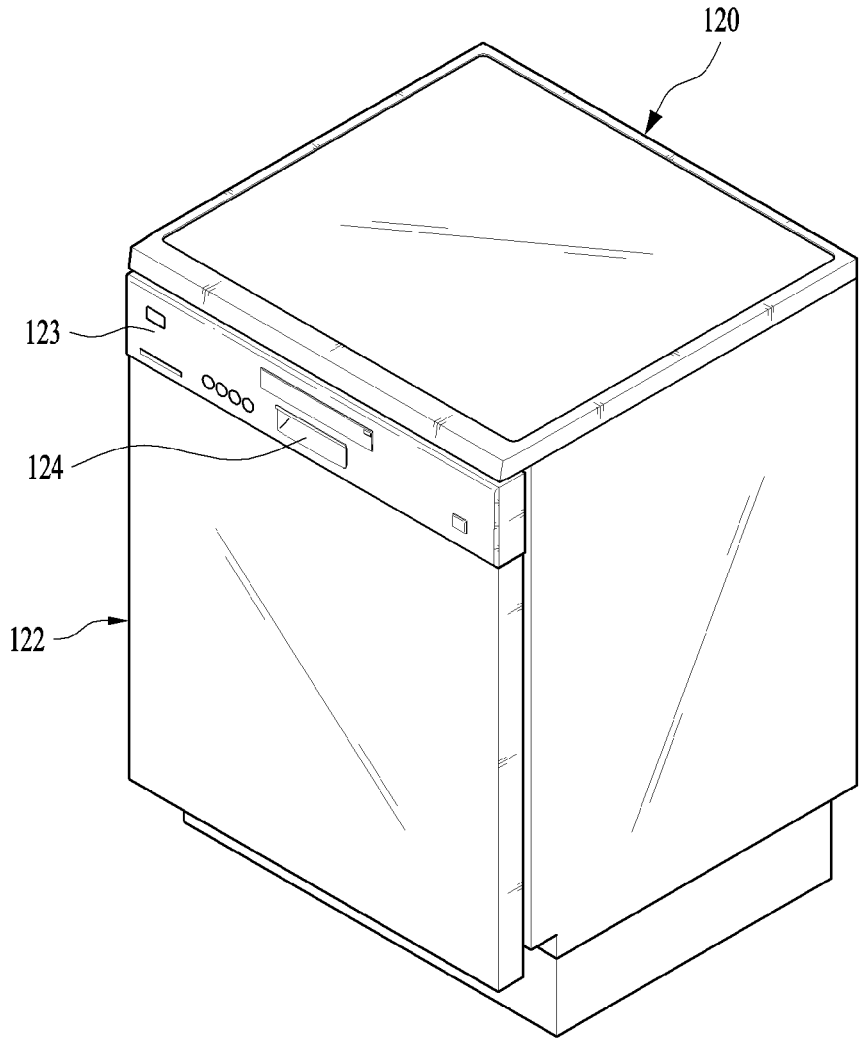

[Fig. 2]
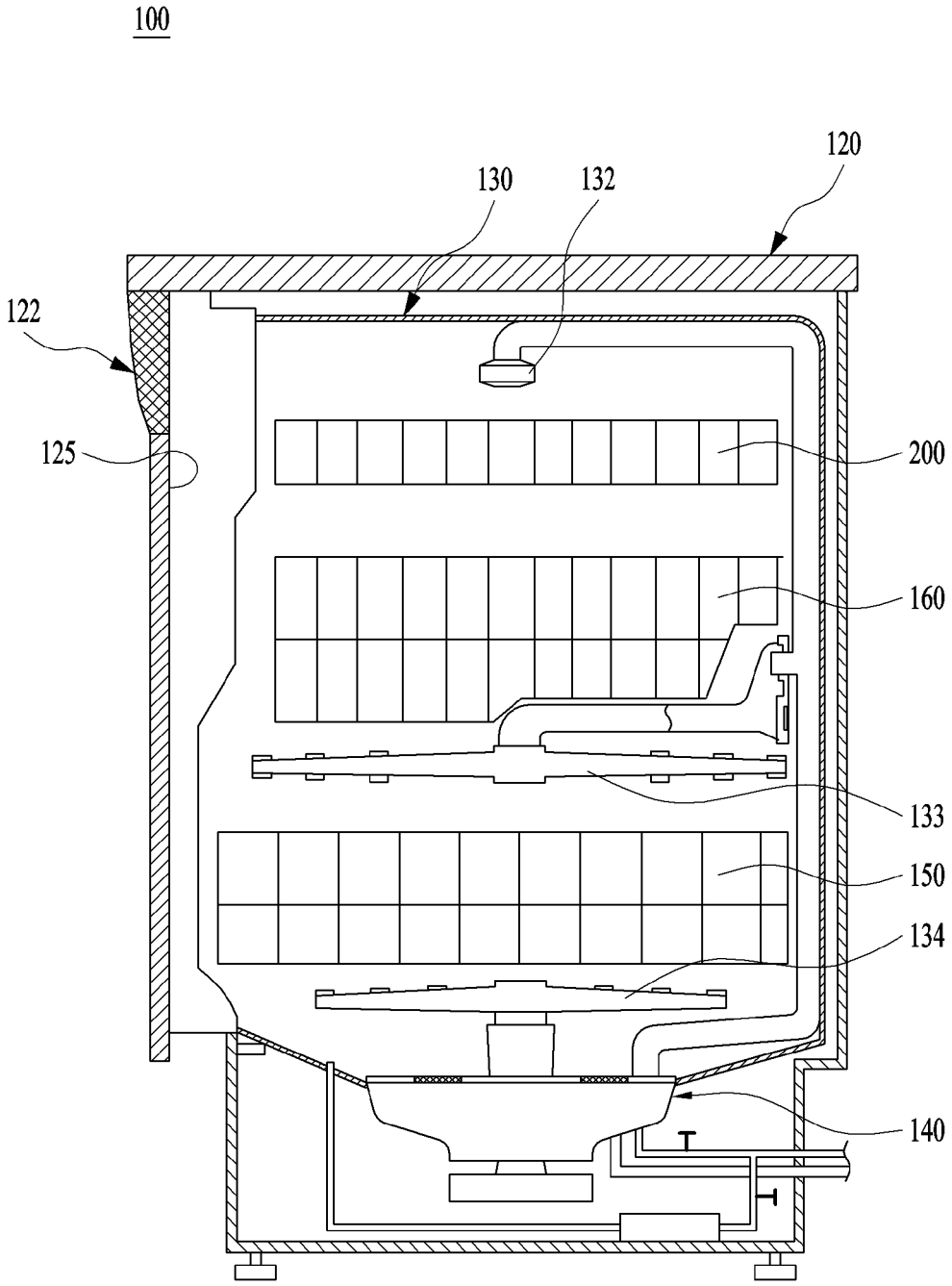

[Fig. 3]
200
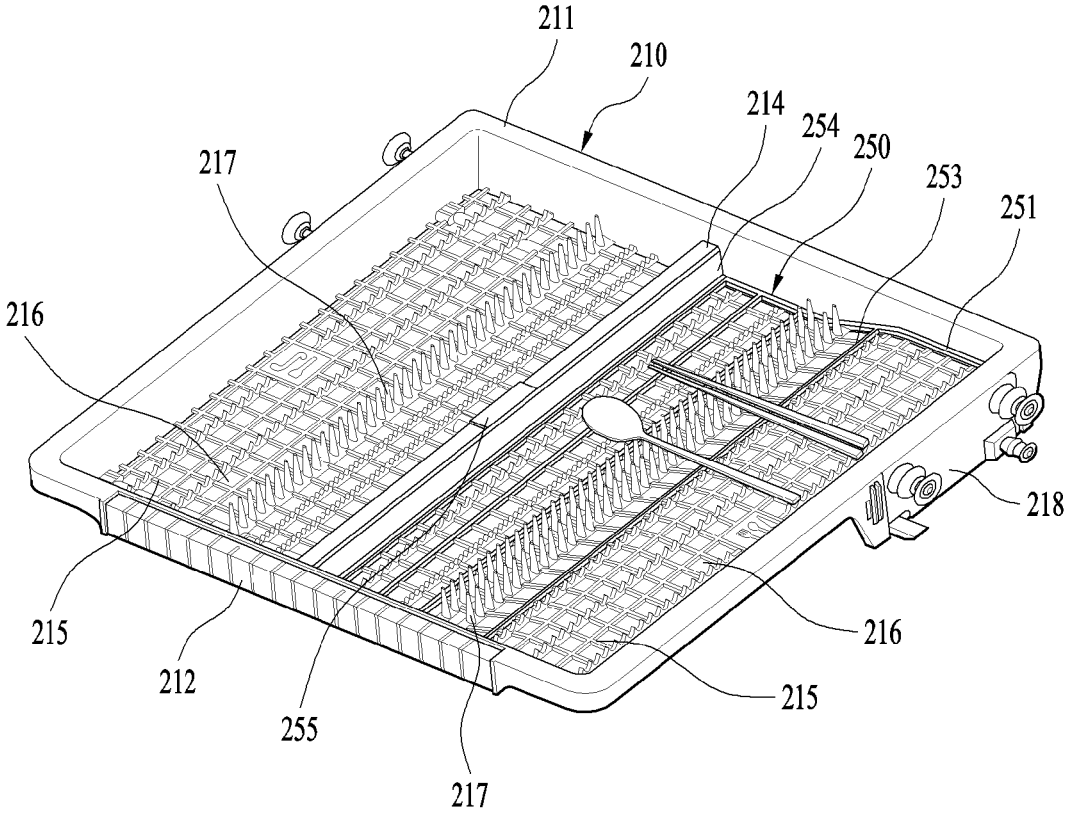

[Fig. 4]
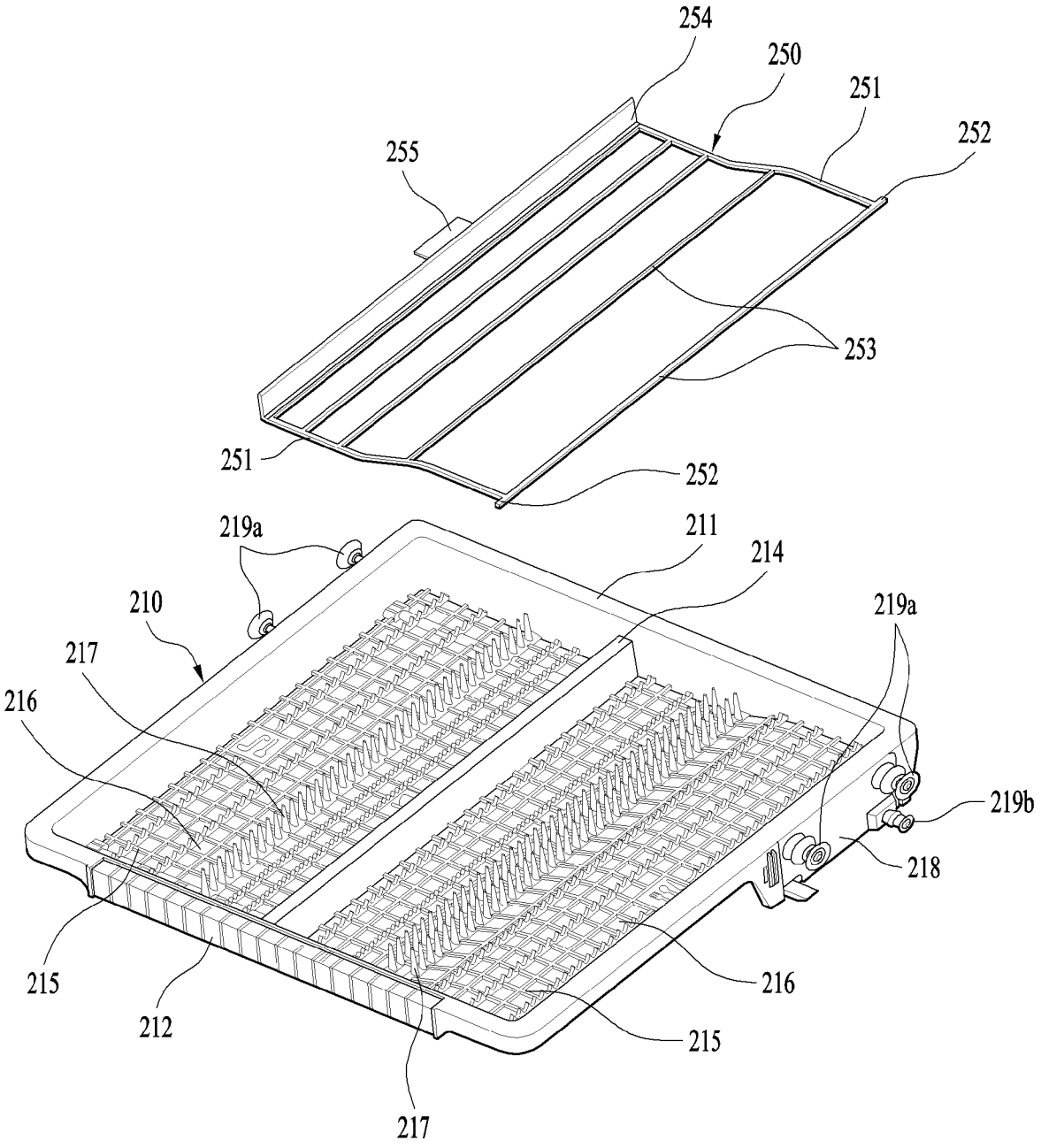

[Fig. 5]
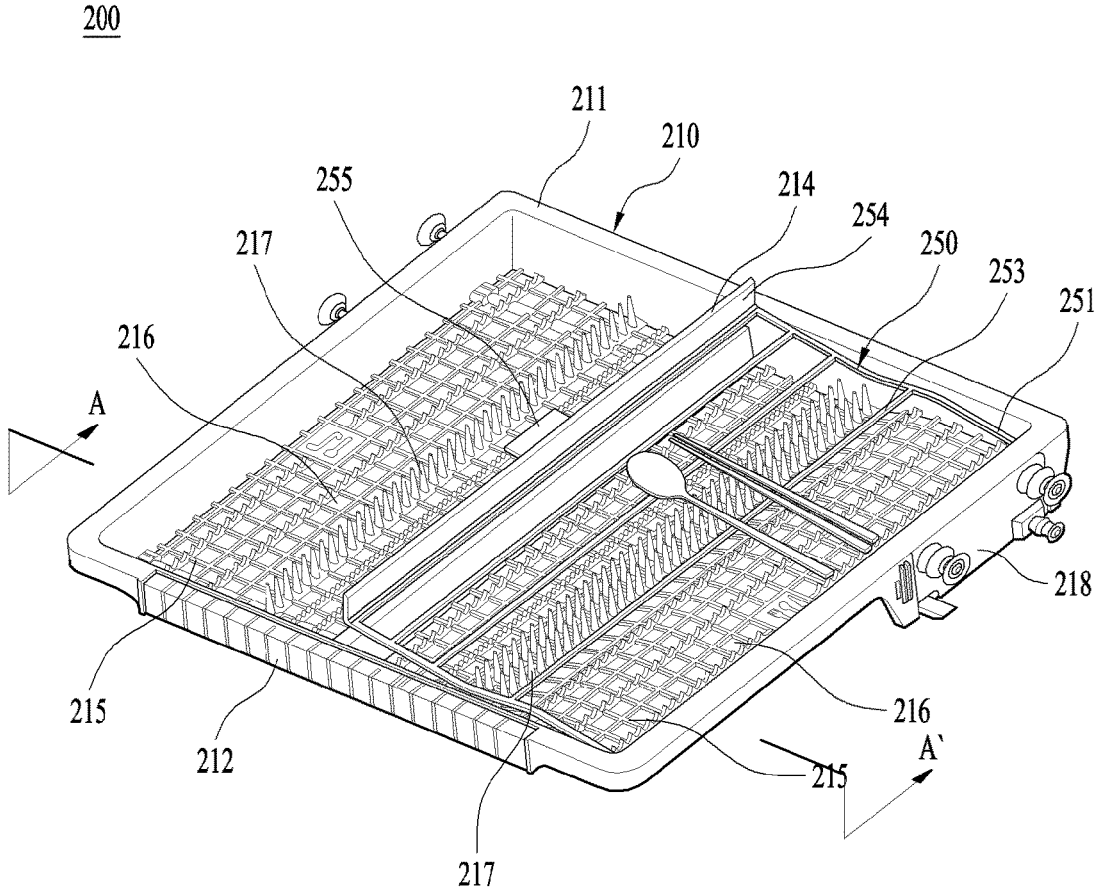
[Fig. 6]
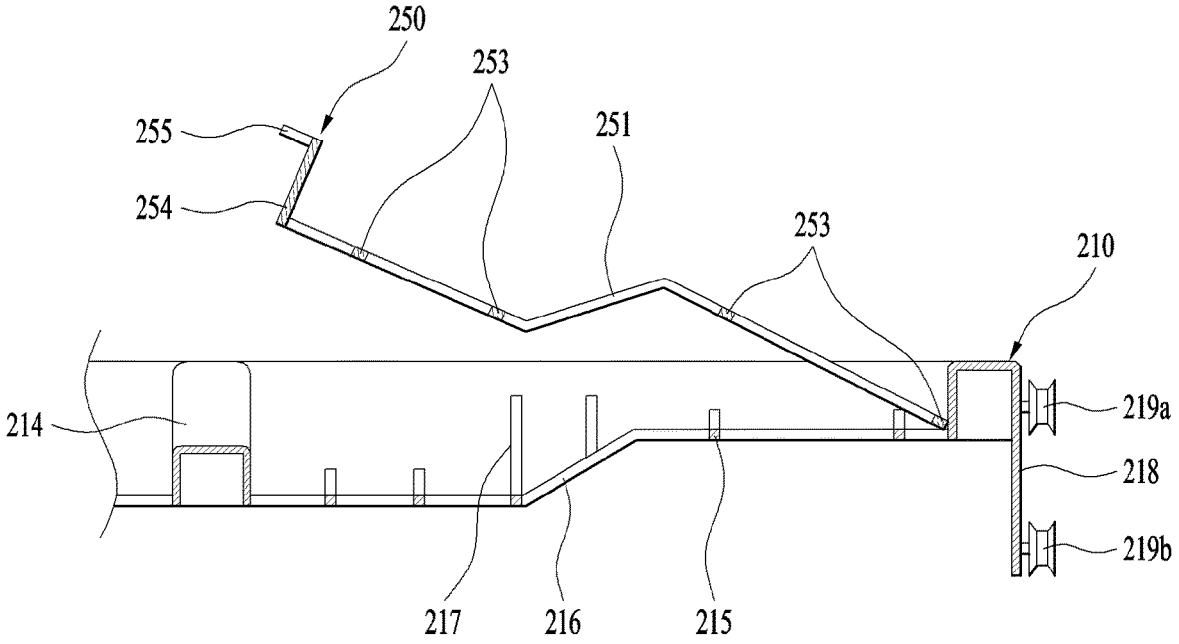

RACK AND DISHWASHER INCLUDING THE SAME

CROSS-REFERENCE TO RELATED APPLICATIONS

This application is a National Stage application under 35 U.S.C. § 371 of International Application No. PCT/KR2016/009020, filed Aug. 17, 2016, which claims the benefit of Korean Application No. 10-2015-0116195, filed on Aug. 18, 2015. The disclosures of the prior applications are incorporated by reference in their entirety.

TECHNICAL FIELD

The present invention relates to a rack and a dishwasher including the same, and more particularly, to a rack configured to be easily introduced into and withdrawn from a dishwasher and to allow a user to easily handle dishes received in the rack and a dishwasher including the same.

BACKGROUND ART

Generally, a dishwasher is an apparatus that sprays high-pressure wash water to dishes received therein to wash the dishes and dries the washed dishes. Specifically, the dishwasher is operated such that high-pressure wash water is sprayed into a tub, in which dishes are received, and the sprayed wash water removes foreign matter, such as food waste, from the surfaces of the dishes.

The dishwasher is configured such that food waste contained in wash water is filtered by a filter for reuse of the used wash water and such that wash water containing detergent is supplied to smoothly separate food waste from dishes. In recent years, a dishwasher that increases the temperature of wash water or generates steam using a heater to improve washing efficiency has been widely used.

A conventional dishwasher includes a case defining the external appearance thereof, a washing tub provided in the case for defining a washing space in which dishes are washed, a door disposed in front of the washing tub for opening and closing the washing tub, a drive unit provided under the washing tub for supplying, collecting, circulating, and draining wash water, lower, upper, and top spraying units for spraying wash water supplied by the drive unit to the dishes, and lower, upper, and top racks separably provided between the lower, upper, and top spraying units, the lower, upper, and top racks being selectively loaded in the washing tub based on the kind or size of the dishes.

Each rack is provided at the lower part thereof with a plurality of moving rollers, which are guided along guide rails provided at the inside of the washing tub such that the rack is introduced into or withdrawn from the washing tub.

The lower rack is disposed adjacent to the lower spraying unit to receive relatively large-sized dishes. The upper rack is disposed adjacent to the upper spraying unit to receive relatively small-sized dishes. The top rack is disposed adjacent to the top spraying unit to receive eating utensils (e.g. spoons and knives) and cooking utensils (e.g. dippers and whisks) having smaller sizes than dishes.

In order to wash dishes using the dishwasher, a user opens the door of the dishwasher, withdraws one of the racks from the washing tub, places dishes in the withdrawn rack, pushes the withdrawn rack back into the washing tub of the dishwasher, and closes the door.

Subsequently, when the user operates the dishwasher, wash water is individually or simultaneously supplied to the lower, upper, and top spraying units according to the operation of the drive unit in order to wash the dishes loaded in the lower, upper, and top racks.

The eating utensils and the cooking utensils, which are loaded in the top rack, are individually withdrawn and arranged after washing is completed. The sizes of the eating utensils and the cooking utensils, which are loaded in the top rack, are relatively small. In particular, each of the eating utensils and the cooking utensils has a predetermined length. When washing is completed, therefore, the eating utensils and the cooking utensils are individually withdrawn from the top rack, which is troublesome.

DISCLOSURE OF INVENTION

Technical Problem

An object of the present invention devised to solve the problem lies in a rack configured such that dishes are more conveniently withdrawn therefrom after washing is completed and a dishwasher including the same.

Solution to Problem

The object of the present invention can be achieved by providing a rack including a receiving box having a loading unit on which dishes are loaded and a turnable withdrawal unit coupled to the loading unit in a state of being in contact with the loading unit so as to be turned upward for separating the dishes, loaded on the loading unit, from the loading unit when turned.

The dishes may be eating utensils and/or cooking utensils.

The receiving box may have an outer edge rib defining the outer edge of the loading unit, and the turnable withdrawal unit may be turnably coupled to the inner surface of the outer edge rib.

The loading unit may be provided with a plurality of support protrusions for supporting the dishes, and the turnable withdrawal unit may be located on the loading unit so as not to interfere with the support protrusions.

The loading unit may be provided with a plurality of through holes through which wash water for washing the dishes passes, and the turnable withdrawal unit may be located on the loading unit so as not to interfere with the through holes.

The turnable withdrawal unit may be formed to have a lattice shape constituted by a plurality of horizontal support bars and a plurality of vertical support bars, one side of the turnable withdrawal unit may be turnably coupled to the loading unit, and the other side of the turnable withdrawal unit may be provided with a holding protrusion for turning the turnable withdrawal unit.

In another aspect of the present invention, provided herein is a dishwasher including a washing tub for defining a washing space, a rack provided in the washing tub so as to be withdrawn from the washing tub for receiving dishes, and a plurality of spraying units for spraying wash water to the rack, wherein the rack includes a receiving box having a loading unit on which dishes are loaded and a turnable withdrawal unit coupled to the loading unit in a state of being in contact with the loading unit so as to be turned upward for separating the dishes, loaded on the loading unit, from the loading unit when turned.

The turnable withdrawal unit may be formed to have a lattice shape constituted by a plurality of horizontal support bars and a plurality of vertical support bars, one side of the turnable withdrawal unit may be turnably coupled to the loading unit, and the other side of the turnable withdrawal unit may be provided with a holding protrusion for turning the turnable withdrawal unit.

Advantageous Effects of Invention

In the rack according to the present invention and the dishwasher including the same, it is possible to for user to easily withdraw dishes from the rack.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view showing a dishwasher according to the present invention;

FIG. 2 is a view simply showing the internal structure of the dishwasher according to the present invention;

FIG. 3 is a perspective view showing a third rack of the dishwasher according to the present invention;

FIG. 4 is an exploded perspective view showing the third rack of the dishwasher according to the present invention; and FIGS. 5 and 6 are perspective views showing the state in which the dishwasher according to the present invention is used.

BEST MODE FOR CARRYING OUT THE INVENTION

Reference will now be made in detail to the preferred embodiments of the present invention, examples of which are illustrated in the accompanying drawings.

In the following description of the present invention, names of constituent elements are defined in consideration of functions in the present invention. Therefore, the names of the constituent elements must not be construed as having meanings that restrict technical elements of the present invention. In addition, the names defined for the respective constituent elements may be substituted with other names in the art to which the present invention pertains.

Hereinafter, a dishwasher according to an embodiment of the present invention will be described in detail with reference to the accompanying drawings.

FIG. 1 is a perspective view showing a dishwasher according to the present invention, and FIG. 2 is a view simply showing the internal structure of the dishwasher according to the present invention.

As shown in FIGS. 1 and 2, a dishwasher 100 according to the present invention includes a case 120 defining the external appearance thereof, a washing tub 130 mounted in the case 120 for defining a washing space, in which dishes are washed, the washing tub 130 having a front open surface, a door 122 for opening and closing the open surface of the washing tub 130, a drive unit 140 provided under the washing tub 130 for supplying, collecting, circulating, and draining wash water, a plurality of racks 150, 160, and 200 separably provided in the washing tub 130 for receiving dishes, and a plurality of spraying units 132, 133, and 134 respectively provided adjacent to the racks 150, 160, and 200 for spraying wash water to wash dishes.

The washing tub 130, the driving unit 140, and the spraying units of the dishwasher 100 may have the same structures as or similar structures to those of a conventional dishwasher, and therefore a detailed description thereof will be omitted.

The racks 150, 160, and 200 are provided in the washing tub 130 so as to be withdrawn from the washing tub 130 through the open surface of the washing tub 130. The racks include a first rack 150 provided in the lower part of the washing tub 130 for receiving relatively large-sized dishes, a second rack 160 provided above the first rack 150 for receiving relatively small-sized dishes, and a third rack 200 provided in the upper part of the washing tub 130 for receiving cutlery and the like.

The spraying units 132, 133, and 134 are provided to spray wash water to the dishes received in the racks 150, 160, and 200, respectively. The spraying units include a lower spraying unit 134 provided in the lower part of the washing tub 130 for spraying wash water to the first rack 150, an upper spraying unit 133 provided between the first rack 150 and the second rack 160 for spraying wash water to the first and second racks 150 and 160, and a top spraying unit 132 provided in the upper part of the washing tub 130 for spraying wash water to the third rack 200 or the second rack 160.

Guide rails (not shown) for guiding the withdrawal and introduction of the first, second, and third racks 150, 160, and 200 are provided at opposite sidewalls of the washing tub 130. The guide rails may include fixed guide rails (not shown) for guiding the withdrawal and introduction of the first rack 150 and telescopic guide rails (not shown) for guiding the withdrawal and introduction of the second and third racks 160 and 200, the length of the telescopic guide rails being increased as the second and third racks 160 and 200 are withdrawn.

The door 122 is provided to open and close the front open surface of the washing tub 130. The door 122 is provided at the lower end of the open surface thereof with a hinge unit (not shown), about which the door 122 is hingedly rotated such that the door 122 is opened and closed.

The door 122 is provided at the outer surface thereof with a grip 124 for opening the door 122 and a control panel 123 for controlling the dishwasher 100. When the door 122 is closed, the inner surface of the door 122 defines one surface of the washing tub 130. When the door 122 is opened, the inner surface of the door 122 defines a location surface on which the first rack 150 is located. To this end, when the door 122 is opened, the location surface of the door 122 may horizontally extend from the guide rails for guiding the first rack 150.

Specifically, the present invention relates to the third rack 200 and the dishwasher 100 having the same. Consequently, the general construction of the dishwasher 100 and the first and second racks 150 and 160 will not be described.

Hereinafter the third rack 200, which is the gist of the present invention, will be described in detail with reference to the accompanying drawings.

FIG. 3 is a perspective view showing the third rack of the dishwasher according to the present invention, and FIG. 4 is an exploded perspective view showing the third rack of the dishwasher according to the present invention.

As shown in FIGS. 3 and 4, the third rack 200 according to the present invention includes a receiving box 210 provided in the washing tub 130 so as to be withdrawn from the washing tub 130 and a turnable withdrawal unit 250 located on the receiving box 210 for separating dishes, received in the receiving box 210, from the receiving box 210 when turned.

The receiving box 210 includes a loading unit 215 on which dishes to be washed in the washing tub 130 are loaded, an outer edge rib 211 protruding from the outer edge of the loading unit 215 for preventing the dishes, loaded on the loading unit 215, from being separated from the loading unit 215, a middle partition rib 214 extending along the middle of the loading unit 215 in the direction in which the receiving box 210 is withdrawn for partitioning the loading unit 215 into two loading regions, and moving roller units 218 provided at opposite sides of the outer edge rib 211 so as to be guided along the telescopic guide rails in the washing tub.

The loading unit 215 is formed to have a plate shape having a predetermined size. The loading unit 215 is provided in the lower surface thereof with a plurality of through holes 216, through which wash water passes when the dishes loaded on the loading unit 215 are washed. The loading unit 215 has a lattice structure, which is formed by the through holes 216, such that dishes are stably located on the loading unit 215. In addition, a plurality of support protrusions 217 for supporting the dishes loaded in the receiving box to prevent the movement of the dishes during the washing of the dishes or to prevent the movement of the second rack 200 is provided at predetermined regions of the loading unit 215.

The outer edge rib 211 protrudes upward from the outer edge of the loading unit 215 to define a loading space in which dishes are loaded. A grip 212 for withdrawing the third rack 200 is formed on the front end of the outer edge rib 211 (i.e. at the front end of the outer edge rib 211 in the direction in which the third rack 200 is withdrawn).

The moving roller units 218 are provided at opposite sides of the outer edge rib 211 (i.e. at opposite sides of the outer edge rib 211 in the direction in which the third rack 200 is withdrawn) to support the upper surfaces and lower surfaces of the telescopic guide rails, which are provided at the opposite inner sidewalls of the washing tub 130 such that the receiving box 210 is withdrawn from the washing tub. The moving roller units 218 are formed by extending the opposite side surfaces of the outer edge rib 211. The moving roller units 218 include upper moving rollers 219*a* for supporting the upper surfaces of the telescopic guide rails and lower moving rollers 219*b* for supporting the lower surfaces of the telescopic guide rails.

The middle partition rib 214 is provided to partition the loading unit 215 into two loading regions. The middle partition rib 214 extends from the outer edge rib 211, which defines the outer edge of the loading unit 215, to the inside of the loading unit 215 in order to partition the loading unit 215 into two loading regions. In addition, the middle partition rib 214 supports the turnable withdrawal unit 250, a description of which will follow.

The outer edge rib 211, which defines the outer edge of the loading unit 215, is provided at corresponding portions of front and rear ends thereof adjacent to one side thereof with a pair of rotary shaft holes (not shown), into which the turnable withdrawal unit 250 is turnably coupled.

The turnable withdrawal unit 250 is turnably coupled to one side of the loading unit 215 so as to be turned by a user after washing of dishes is completed in order to separate the dishes from the bottom of the loading unit 215 or the support protrusions 217 of the loading unit 215 such that the user is capable of easily grasping the dishes loaded on the turnable withdrawal unit 250.

The turnable withdrawal unit 250 includes a plurality of horizontal support bars 251 and vertical support bars 253 arranged in the shape of a lattice for locating dishes, a pair of rotary shafts 252 formed at opposite ends of one side defined by the horizontal support bars 251 and the vertical support bars 253 so as to be turnably coupled into the rotary shaft holes in the receiving box 210, and a turnable support bar 254 provided at the other side defined by the horizontal support bars 251 and the vertical support bars 253, the turnable support bar 254 having a holding protrusion 255 for allowing the user to hold the turnable withdrawal unit 250.

Some of the horizontal support bars 251 and the vertical support bars 253 arranged in the shape of a lattice to constitute the turnable withdrawal unit 250 may be omitted as needed.

The turnable withdrawal unit 250 may be formed to have a shape corresponding to the inner edge shape of the loading unit 215, which is defined by the outer edge rib 211 and the middle partition rib 214. In addition, the turnable withdrawal unit 250 may be bent along the shape of the bottom surface of the loading unit 215.

The horizontal support bars 251 and the vertical support bars 253 of the turnable withdrawal unit 250 are arranged so as not to interfere with the support protrusions 217 formed on the loading unit 215. When the turnable withdrawal unit 250 is located on the loading unit 215, therefore, the support protrusions 217 may protrude through the turnable withdrawal unit 250. In addition, the horizontal support bars 251 and the vertical support bars 253 of the turnable withdrawal unit 250 are arranged so as not to interfere with the through holes 216 formed in the loading unit 215. When the turnable withdrawal unit 250 is located on the loading unit 215, therefore, the turnable withdrawal unit 250 does not disturb the movement of wash water through the through holes 216.

Hereinafter, the operation of the racks provided in the dishwasher according to the embodiment of the present invention will be described in detail with reference to the accompanying drawings. It should be noted that the elements mentioned below are to be understood with reference to the above description and drawings.

FIGS. 5 and 6 are perspective views showing the state in which the dishwasher according to the present invention is used.

In order for the user to wash dishes using the dishwasher 100, the user opens the door 122 of the dishwasher 100, withdraws at least one of the first, second, and third racks 150, 160, and 200, loads dishes into the withdrawn rack, reintroduces the rack, in which the dishes are placed, into the washing tub 130 of the dishwasher 100, and closes the door 122.

Subsequently, when the user operates the dishwasher 100, wash water is individually or simultaneously supplied to the upper spraying unit 133, the lower spraying unit 134, and the top spraying unit in response to the operation of the drive unit 140, and the dishes loaded in the racks 150, 160, and 200 are washed, rinsed, and dried. The washing, rinsing, and drying of the dishes described above are very similar to the operation of a general dishwasher 100, and therefore a detailed description thereof will be omitted.

Before the dishwasher 100 is operated, it is necessary to place dishes in the respective racks. In addition, it is necessary to withdraw a specific one of the racks in order to place dishes in the specific rack.

The first rack 150 is moved while being guided along the fixed guide rails provided at the lower parts of the inner opposite surfaces of the washing tub 130. When withdrawn, the first rack 150 is located on the location surface of the door 122. Dishes are received in the first rack 150 in the state in which the first rack 150 is located on the location surface of the door 122.

The second rack 160 and the third rack 200 are moved while being guided along the telescopic guide rails provided at the inner opposite surfaces of the washing tub 130. Dishes are loaded in the second rack 160 and the third rack 200 in the state in which the second rack 160 and the third rack 200 are supported by the telescopic guide rails, the lengths of which have been increased.

The third rack 200 is provided to receive relatively small-sized dishes. Dishes are loaded on the turnable withdrawal unit 250 in the state in which the turnable withdrawal unit 250 is located in the receiving box of the third rack 200. The third rack 200, in which the dishes are loaded, is introduced into the washing tub 130 such that the dishes loaded in the third rack 200 are washed.

When the washing of the dishes loaded in the third rack 200 is completed, the user opens the door 122 of the dishwasher 100, withdraws the third rack 200 while holding the grip formed at the receiving box 210 of the third rack 200, and withdraws the dishes from the receiving box 210. The dishes loaded in the receiving box 210 may be easily withdrawn through the turnable withdrawal unit 250 located in the receiving box 210.

Specifically, the user turns the turnable withdrawal unit 250 upward from the receiving box 210 of the third rack 200, which has been withdrawn after washing of the dishes has been completed, while holding the holding protrusion 255 of the turnable withdrawal unit 250. As a result, the turnable withdrawal unit 250 is turned upward about the rotary shafts 252, which are turnably coupled into the rotary shaft holes formed in the receiving box 210.

As the turnable withdrawal unit 250 is turned upward, the dishes loaded on the turnable withdrawal unit 250 are lifted so as to be separated from the upper surface of the loading unit of the receiving box 210 in the state of being supported by the support bars 251 and the vertical support bars 253 of the turnable withdrawal unit 250. Consequently, the user may hold the dishes lifted by the turnable withdrawal unit 250 and may easily move the held dishes to another storage box.

MODE FOR THE INVENTION

Various embodiments have been described in the best mode for carrying out the invention.

INDUSTRIAL APPLICABILITY

The present invention provides a rack configured to be easily introduced into and withdrawn from a dishwasher and to allow a user to easily handle dishes received in the rack and a dishwasher including the same.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A rack comprising:

a receiving box comprising a loading unit configured to receive dishes, an outer edge rib that defines an outer edge of the loading unit, and a middle partition rib that extends along a middle portion of the loading unit to partition the loading unit; and a turnable withdrawal unit that is connected to the loading unit, that is disposed between the outer edge rib and the middle partition rib, and that is configured to, in a state of being in contact with the loading unit, rotate upward relative to the loading unit to thereby separate the dishes from the loading unit, wherein the turnable withdrawal unit comprises:

a plurality of horizontal support bars that are configured to support the dishes, a plurality of vertical support bars that connect between the plurality of horizontal support bars and that define a lattice shape with the plurality of horizontal support bars, a pair of rotary shafts that rotatably couple the turnable withdrawal unit to the loading unit and that are disposed at opposite ends of one of the plurality of vertical support bars disposed at a first side of the turnable withdrawal unit, a turnable support bar disposed at a second side of the turnable withdrawal unit, and a holding protrusion that protrudes from the turnable support bar and that allows a user to grip to rotate the turnable withdrawal unit about the pair of rotary shafts to thereby lift the second side of the turnable withdrawal unit relative to the loading unit.

2. The rack according to claim 1, wherein the dishes are eating utensils and/or cooking utensils.

3. The rack according to claim 1, wherein the receiving box further comprises moving roller units provided at opposite sides of the outer edge rib.

4. The rack according to claim 1, wherein the loading unit is provided with a plurality of support protrusions for supporting the dishes, and the turnable withdrawal unit is located on the loading unit so as not to interfere with the support protrusions.

5. The rack according to claim 1, wherein the loading unit is provided with a plurality of through holes through which wash water for washing the dishes passes, and the turnable withdrawal unit is located on the loading unit so as not to interfere with the through holes.

6. The rack according to claim 1, wherein the middle partition rib partitions the loading unit into a first loading space and a second loading space that are spaced apart from each other, and wherein the turnable withdrawal unit is disposed in one of the first loading space or the second loading space.

7. The rack according to claim 1, wherein the holding protrusion faces an upper surface of the middle partition rib and is configured to rest on the upper surface of the middle partition rib.

8. The rack according to claim 1, wherein the first side of the turnable withdrawal unit faces the outer edge rib, and the second side of the turnable withdrawal unit faces the middle partition rib.

9. The rack according to claim 1, wherein the turnable support bar protrudes upward from and extends along one of the plurality of vertical support bars that is disposed at the second side of the turnable withdrawal unit.

10. The rack according to claim 1, wherein the turnable support bar has:

a first end connected to one of the plurality of vertical support bars that is disposed at the second side of the turnable withdrawal unit; and a second end that is disposed upward relative to the first end and that is connected to the holding protrusion.

11. The rack according to claim 1, wherein the turnable support bar protrudes in a first direction from one of the plurality of vertical support bars that is disposed at the second side of the turnable withdrawal unit, and wherein the holding protrusion protrudes from the turnable support bar in a second direction transverse to the first direction.

12. The rack according to claim 1, wherein the plurality of horizontal support bars comprise:

a first horizontal support bar that connects first ends of the plurality of vertical support bars; and a second horizontal support bar that connects second ends of the plurality of vertical support bars, and wherein the pair of rotary shafts comprise a first rotary shaft that protrudes from the first horizontal support bar, and a second rotary shaft that protrudes from the second horizontal support bar.

13. A dishwasher comprising:

a washing tub that defines a washing space;

a rack provided in the washing tub and configured to be withdrawn from the washing tub for receiving dishes; and a plurality of spraying units configured to wash water to the rack, wherein the rack comprises:

a receiving box comprising a loading unit configured to receive dishes, an outer edge rib that defines an outer edge of the loading unit, and a middle partition rib that extends along a middle portion of the loading unit to partition the loading unit, and a turnable withdrawal unit that is connected to the loading unit, that is disposed between the outer edge rib and the middle partition rib, and that is configured to, in a state of being in contact with the loading unit, rotate upward relative to the loading unit to thereby separate the dishes from the loading unit, and wherein the turnable withdrawal unit comprises:

a plurality of horizontal support bars that are configured to support the dishes, a plurality of vertical support bars that connect between the plurality of horizontal support bars and that define a lattice shape with the plurality of horizontal support bars, a pair of rotary shafts that rotatably couple the turnable withdrawal unit to the loading unit and that are disposed at opposite ends of one of the plurality of vertical support bars disposed at a first side of the turnable withdrawal unit, a turnable support bar disposed at a second side of the turnable withdrawal unit, and a holding protrusion that protrudes from the turnable support bar and that allows a user to grip to rotate the turnable withdrawal unit about the pair of rotary shafts to thereby lift the second side of the turnable withdrawal unit relative to the loading unit.

14. The dishwasher according to claim 13, wherein the loading unit is provided with a plurality of support protrusions for supporting the dishes, and the turnable withdrawal unit is located on the loading unit so as not to interfere with the support protrusions.

* * * * *